US005173713A

United States Patent [19]

Yves et al.

[11] Patent Number: 5,173,713

[45] Date of Patent: Dec. 22, 1992

[54] THREE ELEMENT INVERTED CONICAL MONOPOLE WITH SERIES INDUCTANCE AND RESISTANCE IN EACH ELEMENT

[75] Inventors: Foissac Yves, Valenciennes; Jean M. Demancel, Lecelles, both of France

[73] Assignee: Laboratorie d'Etudes et de Researches Chimiques (LERC) S.A., Saint Amand les Eaux, France

[21] Appl. No.: 640,821

[22] Filed: Jan. 14, 1991

[51] Int. Cl.[5] ..... H01Q 9/44

[52] U.S. Cl. ..... 343/749; 343/826

[58] Field of Search ..... 343/722, 715, 749, 745, 343/750, 751, 752, 900, 826, 893, 844, 846, 702, 735, 736

[56] References Cited

U.S. PATENT DOCUMENTS

| | | | |
|---|---|---|---|
| 2,127,198 | 8/1938 | Alford | 343/735 |
| 2,208,749 | 7/1940 | Cork et al. | 343/735 |
| 3,550,138 | 12/1970 | Guertler et al. | 343/751 |
| 3,852,766 | 12/1974 | Olson et al. | 343/844 |
| 3,984,839 | 10/1976 | Ray, Jr. | 343/844 |
| 4,302,760 | 11/1981 | Laufer | 343/715 |
| 4,349,825 | 9/1982 | Shmitka | 343/750 |
| 4,466,003 | 8/1984 | Royce | 343/749 |
| 4,750,000 | 6/1988 | Schroeder | 343/751 |
| 4,890,116 | 12/1989 | Lewis, Jr. | 343/749 |

FOREIGN PATENT DOCUMENTS

| | | | |
|---|---|---|---|
| 0736836 | 9/1955 | Australia | 343/749 |
| 0154653 | 4/1982 | Fed. Rep. of Germany | 343/749 |

*Primary Examiner*—Michael C. Wimer
*Assistant Examiner*—Tan Ho
*Attorney, Agent, or Firm*—Kerkam, Stowell, Kondracki & Clarke

[57] ABSTRACT

The invention relates to a radioelectric communication antenna with a very wide band width and a low standing wave ratio. The antenna includes at least two linear elements in combination that are substantially the same length (L). The median axis (42) of the antenna forms a predetermined angle (A), the apex of which, when the angle (A) differs from 0°, is a point (P) close to the bases (40) which are adapted to be electrically connected to a transmission line (2). Each linear element includes at least one electrically resistive means (5) disposed between two predetermined portions of each element, and at least one electrically inductive means (6), which in turn is disposed substantially between the base (40) of each element (4) and the transmission line (2). The inductive means (6) have selected inductances (L1, L2, L3) which differ from one linear element to another.

24 Claims, 1 Drawing Sheet

THREE ELEMENT INVERTED CONICAL MONOPOLE WITH SERIES INDUCTANCE AND RESISTANCE IN EACH ELEMENT

FIELD OF THE INVENTION

The invention relates to a radioelectric antenna having a very wide band width and a low standing wave ratio and is intended in particular for mobile communication devices that use high frequency communication frequencies.

More particularly, but not exclusively, the invention relates to an antenna that on the one hand has a high output and a low standing wave ratio, especially in the high frequency band between 3 and 30 MHz. The standing wave ratio and output characterize the aptitude of an antenna to effectively disperse the electrical energy that has been supplied to it in the form of electromagnetic energy.

BACKGROUND OF THE INVENTION

In the field of radioelectric transmissions, it is necessary to have antennas that on the one hand are lightweight and easy to use, or in other words essentially have little bulk, and on the other hand have high radioelectric efficiency, that is, in which the standing wave ratio is as low as possible in view of a high output.

Currently, high-output antennas with a low standing wave ratio are known, but only within a very narrow frequency band. To be able to cover a wide frequency band, it is known to cut the band into successive zones and to use a specific antenna for each zone in accordance with the communication frequency. It is also known to use only a single antenna, but to re-adapt it and/or to retune it electronically so that it has acceptable radioelectric characteristics at the selected communication frequency.

While antenna changing and/or retuning manipulations may be automated, such procedures are incompatible when using transmitter and receiver devices that change their operating frequency rapidly and frequently, in synchronism with one another. Such techniques are important for confidential communications. Nevertheless, the width of the frequency band in which these communication devices operate is implicitly limited to that within which the antenna can be used without disadvantages. However, the useful band width of an antenna has recently been extended, particularly in the very high frequency range, that is, between 30 and 90 MHz, for example.

In particular, one of the solutions adopted is described in U.S. Pat. No. 4,302,760 and has to do essentially with the construction of the antenna. Specifically, the antenna includes a plurality of linear conductor elements of different selected lengths that on the one hand are disposed parallel, electrically insulated from one another, at the top of a longitudinal support, and on the other hand have one of their ends electrically connected to a common line. According to the patentees of the aforementioned patent, an antenna of this type has given excellent results with a range of frequencies between 30 and 88 MHz. Unfortunately, it was not possible to exploit this solution successively in the field of high frequency communications, that is, below 30 MHz.

As a general rule, the length of a monopole antenna, that is, an antenna comprising a linear conductor element, corresponds to the square of the wavelength at the lowest frequency at which the antenna is used. To cover a frequency band above 3 MHz, one of the linear elements of the antenna in the aforementioned version must have a length of 18.2 m, which is entirely incompatible with mobile communications.

In the field of high frequencies, another version adopted by engineers is described in French Patent 2.597.266. This version suggests reducing the voltage amplitude ratio substantially for the lowest frequencies of the frequency band to be covered, by interposing electrically resistance means between the antenna and the transmission line to which it is connected. This solution does not yield good results except for a very narrow frequency band, that is, particularly when the ratio between the highest and the lowest frequency of the band is 3.

Moreover, if one seeks to apply this single solution to an antenna that operates over a wide band, for example, a band in which the ratio between the highest and the lowest frequency is 10, then a low voltage amplitude ratio can be obtained, but the output of the antenna will also be quite low.

SUMMARY OF THE INVENTION

One object that the invention seeks to obtain is an antenna that operates efficiently over a very wide band and which has a good output and a low standing wave ratio, while its use is compatible with mobile communications devices.

To this end, the subject of the invention is an antenna of the type described above, characterized in particular in that it includes at least two linear elements which, in combination, on the one hand are substantially the same length and with the median axis of the antenna form a predetermined angle, the apex of which, when the angle differs from 0°, is a point close to the base ends, that is, those that are electrically connected to the transmission line, and which on the other hand each include:

- at least one electrically resistive means disposed between two predetermined portions of each element, and
- at least one electrically inductive means which in turn is disposed substantially between the base of each element and the transmission line, these inductive means having selected inductances which differ from one linear element to another.

The invention will be better understood from the ensuing detailed but nonlimiting description of an exemplary embodiment, taken in conjunction with the drawings.

DESCRIPTION OF THE PREFERRED EMBODIMENT

Figure 1:
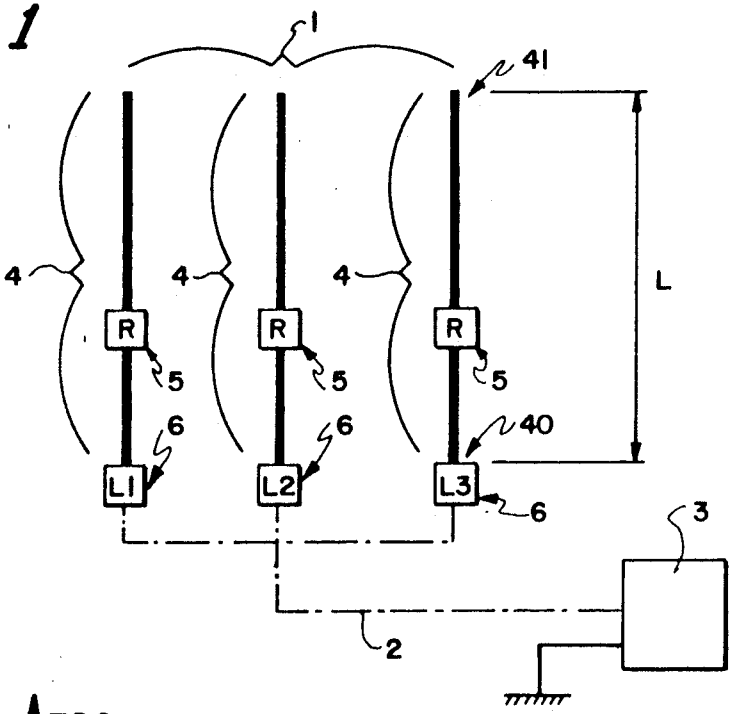
FIG. 1 is a simplified electrical diagram for the antenna.

Turning to the drawing, an antenna 1 is connected by an electrical transmission line 2 to a radioelectric communications device 3 such as a transmitter and/or a receiver. The antenna 1 conventionally includes a plurality of linear elements 4 that conduct electricity, and these elements 4 are each electrically connected to the transmission line 2 by one of their ends 40, 41, such as 40, for example, and this end will hereinafter be called the "base".

Figure 2:
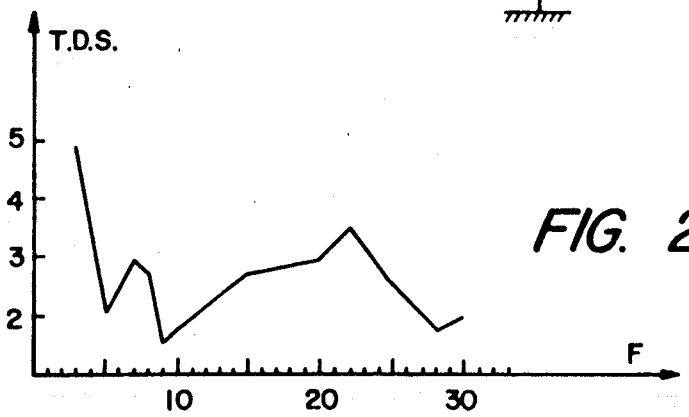
FIG. 2 is a graph showing the progress of the standing wave ratio as a function of the frequency.
Figure 3:
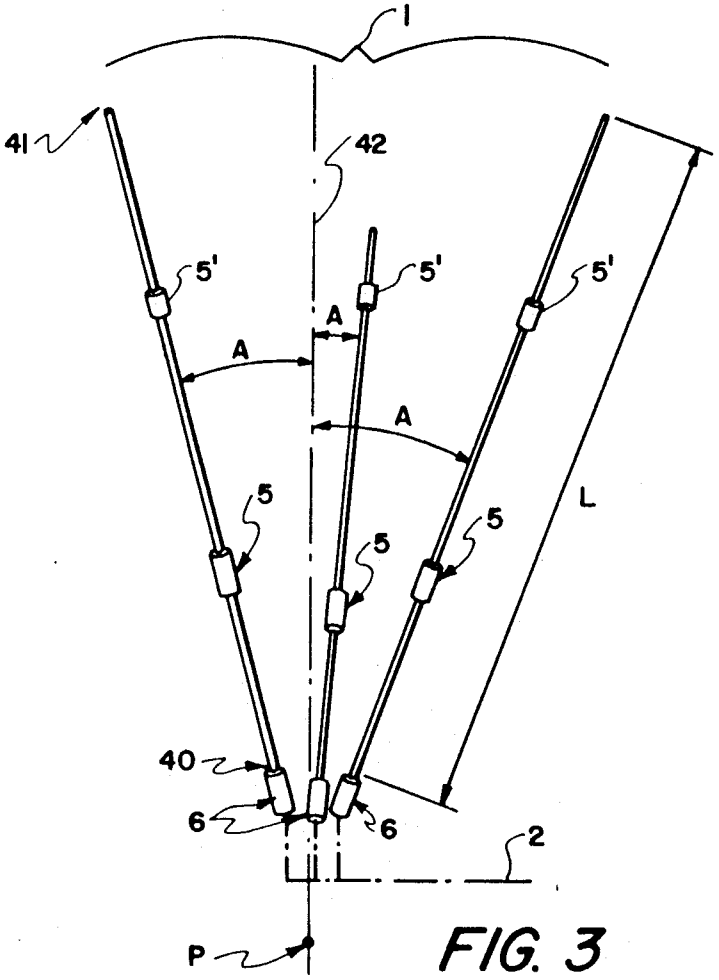
FIG. 3 is a perspective view of an antenna according to the invention in a preferred embodiment.

As seen in FIG. 2, the antenna is designed to have a low standing wave ratio, and in particular less than or equal to 5, in a very wide frequency band that extends from 3 to 30 MHz. Specifically, the standing wave ratio characterizes the propensity that the antennas have to reflect through the transmission line the electrical energy applied to them via this line by a transmitter device.

The antenna of the invention also has an output that progresses substantially from 10% at the lowest frequency to 25% at the highest frequency.

It is also noted that the output of an antenna characterizes its aptitude to disperse, in the form of effective electromagnetic energy, the electrical energy that it has accepted from the transmitter, taking into account its standing wave ratio.

According to the invention, the antenna 1 includes at least two linear elements 4 that are substantially the same length L and form with the median axis 42 of the antenna a predetermined angle A, the apex of which, when the angle A differs from 0°, is a point P close to the base ends 40 electrically connected to the transmission line 2, and on the other hand each include:

at least one electrically resistive means 5 disposed between two predetermined portions of each element, and at least one electrically inductive means 6 which in turn is disposed substantially between the base 40 of each element 4 and the transmission line 2. The inductive means 6 have selected inductances L1, L2, L3 which differ from one linear element to another. The angle A is between 0° and 30°, inclusive, and the resistive means 5 have substantially the same selected resistance R from one linear element to another.

In a preferred embodiment, each linear element includes a resistive means 5, and the resistive means is located substantially one-third of the way along the length of the element, measured from its base end 40 that is associated with the transmission line 2.

In a variant embodiment, each linear element includes two resistive means 5, 5' and these means are substantially located with one of them one-third and one of them two-thirds of the way, respectively, along the length of the element measured from its base end 40.

In a second embodiment, each linear element includes a resistive means 5, and the resistive means is located substantially two-thirds of the way along the length of the element, measured from its base end 40 associated with the transmission line 2.

In an advantageous embodiment of the invention, the antenna includes three divergent linear elements 1 located in planes oriented radially about the median axis 42 of the antenna and offset from one another by approximately 120°. Preferably, each linear element forms an angle of approximately 18° with the median axis 42 of the antenna. The median axis of the antenna is advantageously oriented vertically, and the antenna itself is oriented in such a manner that its elements diverge skyward, i.e., upwards from a general plane.

According to the inventor, it is substantially in the last configuration described above that the antenna obtains the best results.

Specifically, taking into account the drawings, an antenna has been constructed that is composed of three linear elements, each having a length of only approximately 7900 mm, having a useful frequency band extending from 3 MHz to 30 MHz, with an output that progresses from 10% at the lowest frequency to 25% at the highest frequency and a voltage amplitude ratio less than 5 over this frequency band. The antenna includes three linear elements disposed as described above, and each including a resistor 5 having a resistance R of 100Ω located substantially one-third of the way along its length measured from its base end 40. The base end is connected to the transmission line, and a first linear element has an inductor 6 having an inductance L1 of 0.1 μH; a second linear element has an inductor 6 having an inductance L2 of 7.5 μH; and a third linear element has an inductor 6 having an inductance L3 of 22 μH.

Each inductive means 6 is at least in the immediate proximity of the base 40 of a linear element 4. The inductive means may comprise, for example, a winding of conductive wire made directly on the support of the linear element (this support has not been shown, nor has the winding).

In the non-limiting exemplary embodiment of the antenna described above, the short length of the linear elements is notable (less than 8 m) by comparison with the length of the linear elements of a conventional antenna of the type described in the introduction (which is at least 18 m) for the same figure for the low frequency.

What is claimed is:

1. A radioelectric antenna (1) including a plurality of substantially linear electrically conductive elements (4) each having a base and adapted to be electrically connected to a transmission line, said transmission line adapted to be electrically connected to a communication device (3) such as a transmitter and/or receiver device, characterized in that said antenna (1) includes at least three linear elements (4) each having a base end and a distal end and connected to form a monopole omnidirectional antenna whose radiating conductor is made up of said linear elements, said antenna having a median axis (42) that forms a predetermined angle (A) with each of said linear elements such that said linear elements diverge upwardly from the base end to form a point of intersection between said median axis and a longitudinal axis of each of said linear elements at a point (P) spaced from the base ends (40), means for tuning the antenna including at least one electrically resistive element (5) disposed between the base end and the distal end of each linear element and an electrically inductive element (6) disposed between the base end (40) of each linear element (4) and the transmission line (2), the inductive element (6) having selected inductances which differ from one linear element to another.

2. The antenna of claim 1 characterized in that said three divergent linear elements (4) are located in planes oriented radially about the median axis (42) of the antenna and offset from one another by approximately 120°, and each linear element forms an angle of approximately 18° with the median axis (42) of the antenna.

3. The antenna of claim 2, characterized in that the resistive means (5) have substantially equal resistance (R) from one linear element to another.

4. The antenna of claim 2, characterized in that each linear element includes two resistive means (5), and the resistive means are located with one of them approximately two-thirds of the way along the length of the element and one of them approximately one-third of the way along the length of the element, measured from the base end (40).

5. The antenna of claim 2 characterized in that said three linear elements each have a length of approximately 7900 nm, each including a resistor (5) having a resistance (R) of approximately 100 ohms, a first linear element has an inductor (6) having an inductance (L1) less than the inductance of the other inductor elements;

a second linear element has an inductor (6) having an inductance (L2) greater than the inductance of the other inductor elements; and a third linear element has an inductor (6) having an inductance (L3) between the inductance of the other inductive elements.

6. The antenna of claim 5 characterized in that each linear element includes two resistive means (5), and the two resistive means are located with one of them approximately two-thirds of the way along the length of the element and one of them approximately one-third of the way along the length of the element, measured from the base end (40).

7. The antenna of claim 1, characterized in that the resistive means (5) have substantially equal resistance (R) from one linear element to another.

8. The antenna of claim 7 characterized in that each linear element includes two resistive means (5), and the two resistive means are located with one of them approximately two-thirds of the way along the length of the element and one of them approximately one-third of the way along the length of the element, measured from the base end (40).

9. The antenna of claim 1, characterized in that each resistive means is located substantially one-third of the way along the length of the element, measured from its base end (40).

10. The antenna of claim 1, characterized in that said resistive means is located substantially two-thirds of the way along the length of the element, measured from its base end (40).

11. The antenna of claim 1, characterized in that said three linear elements each have a length of approximately 7900 mm, each including a resistor (5) having a resistance (R) of approximately 100 ohms located substantially one-third of the way along its length measured from its base end, a first linear element has an inductor element (6) having an inductance (L1) which is less than the inductance of the other inductor elements;

a second linear element has an inductor element (6) having an inductance (L2) greater than the inductance of the other inductor elements, and a third linear element has an inductor element (6) having an inductance (L3) between the inductance value of the other inductive elements.

12. The antenna of claim 1 characterized in that each linear element includes two resistive means (5), and the resistive means are located with one of them approximately two-thirds of the way along the length of the element and one of them approximately one-third of the way along the length of the element, measured from the base end (40).

13. An antenna as set forth in claim 1 wherein the linear elements diverge outwardly from the median axis of the antenna at an angle less than 30°.

14. An antenna as set forth in claim 13 wherein the angle of divergence of said linear elements is approximately 18°.

15. An antenna as set forth in claim 13 wherein the linear elements are offset from each other at an angle of approximately 120°.

16. A radioelectric antenna (1) including a plurality of substantially linear electrically conductive elements (4), each having a base and adapted to be electrically connected via a transmission line (2) to a communication device (3) such as a transmitter and/or receiver device, characterized in that it includes three linear elements (4) of substantially the same length (1) each having a base end and a distal end and connected to from a monopole omnidirectional antenna whose radiating conductor is made up of said linear elements simulating an inverted cone, said antenna having a median axis (42) that forms a predetermined angle (A) with each of said linear elements such that said linear elements diverge upwardly from the base end to form a point of intersection between said median axis and a longitudinal axis of each of said linear elements spaced from the base ends (40), means for tuning the antenna including at least one electrically resistive element (5) disposed between the base end and the distal end of each linear element and an electrically inductive element (6) disposed between the base end (40) of each linear element (4) and the transmission line (2), the inductive elements (6) having selected inductances (L1, L2, L3) which differ from one linear element to another, thereby forming an antenna having a standing wave ratio equal to or less than 5 in a frequency band between 3 to 30 MHZ.

17. The antenna of claim 16 characterized in that each resistive means is located substantially one-third of the way along the length of the element, measured from its base end (40).

18. An antenna as set forth in claim 17 wherein the linear elements diverge outwardly from the median axis of the antenna at an angle less than 30°.

19. An antenna as set forth in claim 18 wherein the angle of divergence of said linear elements is approximately 18°.

20. An antenna as set forth in claim 19 wherein the linear elements are offset from each other at an angle of approximately 120°.

21. The antenna of claim 16 characterized in that each resistive means is located substantially two-thirds of the way along the length of the element, measured from its base end (40).

22. The antenna of claim 16 characterized in that said three linear elements each have a length of approximately 7900 mm, each including a resistor (5) having a resistance (R) of approximately 100 ohms located along its length spaced from its base end, a first linear element has an inductor (6) having an inductance (L1) less than the inductance of the other inductor elements;

a second linear element has an inductor (6) having an inductance (L2) greater than the inductance of the other inductor elements, and a third linear element has an inductor (6) having an inductance (L3) between the inductance of the other inductor elements.

23. The antenna of claim 22, characterized in that each linear element includes two resistive means (5), and the two resistive means are located with one of them approximately two-thirds of the way along the length of the element and one of them approximately one-third of the way along the length of the element, measured from the base end (40).

24. The antenna of claim 22, characterized in that each linear element includes two resistive means (5), and the resistive means are located with one of them approximately two-thirds of the way along the length of the element and one of them approximately one-third of the way along the length of the element, measured from the base end (40).

* * * * *

UNITED STATES PATENT AND TRADEMARK OFFICE

CERTIFICATE OF CORRECTION

PATENT NO. : 5,173,713
DATED : December 22, 1992
INVENTOR(S) : FOISSAC et al

It is certified that error appears in the above-indentified patent and that said Letters Patent is hereby corrected as shown below: TITLE PAGE:

Under the words United States Patent [19] "Yves et al" should be --Foissac et al--.

In the title [54] "THREE ELEMENT INVERTED CONICAL MONOPOLE WITH SERIES INDUCTANCE AND RESISTANCE IN EACH ELEMENT" should be --INVERTED CONICAL MONOPOLE ANTENNA WITH THREE ELEMENTS HAVING SERIES INDUCTANCE AND RESISTNACE IN EACH ELEMENT --.

The first inventor's name [75] "Foissac Yves" should be --Yves Foissac--.

Col. 5, line 7 (Claim 5, line 3) "nm" should be --mm--.

Col. 6, line 9 (Claim 16, line 3) "base and adapted" should be --base adapted--.

Col. 6, line 14 (Claim 16, line 8) "from" should be --form--.

UNITED STATES PATENT AND TRADEMARK OFFICE

CERTIFICATE OF CORRECTION

PATENT NO. : 5,173,713

DATED : December 22, 1992

INVENTOR(S) : FOISSAC et al

It is certified that error appears in the above-indentified patent and that said Letters Patent is hereby corrected as shown below:

Col. 7, line 5 (claim 24, line 1) "claim 22" should be --claim 16--.

Signed and Sealed this

Seventh Day of March, 1995

*Attest:*

*Attesting Officer*

Bruce Lehman

BRUCE LEHMAN

*Commissioner of Patents and Trademarks*